United States Patent [19]

Manson

[11] 4,440,462

[45] Apr. 3, 1984

[54] SELF-ALIGNING DRAWER AND SLIDE BRACKET ARRANGEMENT THEREFOR AND ASSOCIATED METHOD

[76] Inventor: Morris Manson, Nine Terrace Dr., Drive Neck, N.Y. 11021

[21] Appl. No.: 314,889

[22] Filed: Oct. 26, 1981

[51] Int. Cl.[3] ..... A47B 88/00; F16C 21/00

[52] U.S. Cl. ..... 312/348; 312/330 R; 312/341 R; 312/343; 308/3.8

[58] Field of Search ..... 312/348, 343, 341 R, 312/330 R; 308/3.8

[56] References Cited

U.S. PATENT DOCUMENTS

| | | | |
|---|---|---|---|
| Re. 25,428 | 7/1963 | Manson | 312/343 |
| 2,587,691 | 3/1952 | Brewer | 312/348 |
| 3,022,129 | 2/1962 | Manson | 312/343 |
| 3,675,883 | 7/1972 | Holmes et al. | 312/343 |
| 3,750,993 | 8/1973 | Read | 312/343 |
| 3,926,492 | 12/1975 | Gutner | 312/348 |
| 3,980,365 | 9/1976 | MacDonald et al. | 312/348 |
| 4,018,488 | 4/1977 | Manson | 312/343 |
| 4,176,890 | 12/1979 | Gorton | 312/343 |
| 4,285,560 | 8/1981 | Miller | 312/348 |
| 4,328,998 | 5/1982 | Manson | 308/3.8 |

*Primary Examiner*—Victor N. Sakran

*Attorney, Agent, or Firm*—Posnack, Roberts, Cohen & Spiecens

[57] ABSTRACT

A slide is provided which includes two elongated telescopically engageable members mounted for relative telescopic sliding movement. The members include respective side walls shaped to define longitudinal ball bearing tracks. Ball bearings supported by a carrier are accommodated in the tracks to facilitate relative longitudinal sliding movement between the elongated members. One of the elongated members is connected at one end to the rear of a drawer and at the other end is loosely accommodated in an opening concealed in the front of the drawer thereby permitting self-alignment of the drawer. The other elongated member is fastened to the casing of a piece of furniture or the like. The loosely accommodated end is engaged with a guide installed in the aforementioned opening.

6 Claims, 8 Drawing Figures

SELF-ALIGNING DRAWER AND SLIDE BRACKET ARRANGEMENT THEREFOR AND ASSOCIATED METHOD

FIELD OF THE INVENTION

This invention relates to improved slide brackets for slidably supporting and guiding pull-out drawers or the like and more particularly to drawer arrangements adapted for self-alignment and to related methods.

BACKGROUND

An improvement of the construction in my earlier U.S. Pat. No. Re. 25,482 is shown in U.S. Pat. No. 4,018,488 wherein is disclosed a slide bracket for a drawer assembly comprising two elongated members mounted for relative longitudinal sliding movement, the members including respective opposed side walls shaped to define longitudinal ball bearing tracks. In this arrangement, ball bearings are supported by a carrier and are mounted in the tracks to facilitate the relative longitudinal sliding movement of the elongated members. Further improvements are shown in my copending applications Ser. Nos. 226,912 and 191,164 filed Jan. 21, 1981, and Sep. 26, 1980, respectively, the details of said copending applications being incorporated herein as though set forth in detail.

In the construction and manufacture of furniture and the like, it is a time consuming, labor intensive problem to adjust the positions of drawers and slide brackets therefor, especially in drawer arrangements employing telescopically related slide elements.

SUMMARY OF THE INVENTION

An object of the invention is to provide improved slide bracket constructions and arrangements which are adapted for permitting the self-alignment of slidable drawers.

Another object of the invention is to provide for self-aligning drawer constructions.

Yet another object of the invention is to provide improved methods relating to the manufacture and installing of self-aligning drawers.

In achieving the above and other objects of the invention there is provided an article of manufacture which comprises a case member, a drawer slidably mountable in said case member, and a telescopic slide arrangement coupled between said drawer and said case member and engaging the drawer for sliding displacement relative to said case member. The telescopic slide arrangement includes at least one telescopic member having a loose engagement with the drawer to permit limited displacement between this telescopic member and the drawer thereby to permit a self-alignment of the drawer relative to the case member.

In order to afford the aforesaid loose engagement, there may be provided in accordance with one embodiment of the invention an opening concealed in the drawer with the aforesaid telescopic member protruding into the opening and having a loose fit therein to permit the aforementioned limited displacement. Moreover, in accordance with a particular embodiment of the invention, a guide may be provided at the aforesaid opening with the above-mentioned telescopic member being displaceable along the guide, while being retained by the same in the opening.

More particularly, the drawer may be viewed as including front and rear parts or portions and the above-said telescopic member may be disposed to extend along the outside of the drawer between these front and rear parts. The opening will preferably be concealed in one of these parts, such as the front part. The aforesaid telescopic member may be regarded as including a first end portion extending with loose fit into the opening and a second end portion adjacent the rear part of the drawer. The article will further include connecting arrangements connecting the second end portion to the rear part of the drawer. A second telescopic member included in the telescopic slide arrangement will be mounted on the afore-mentioned case member and will be telescopically coupled with the first said telescopic member.

The above-mentioned opening may preferably be in the form of a blind bore and, according to a specific embodiment, may include a jog of increased dimension at the entry into the opening, the aforesaid guide being located at least partly in the jog to engage and guide displacements of the first mentioned end portion of the first said telescopic member. The guide will function to retain this end portion in the opening although this end portion may be retained in the opening additionally due to the rigidity and length of the first mentioned telescopic member. The guide may, for example, be a pin-like member extending at least partly across the opening with the first mentioned end portion being provided with a hole through which the pin-like member extends.

The second end portion of the first telescopic member may include a flap with the above-mentioned connecting device including a fastener fastening the flap to the rear part of the drawer. To supplement the fastener, a relatively strong glue may furthermore be employed. This flap has a hinge action which abetted by the resilience of the first said telescopic member accomodates displacement of the first end portion in the opening.

To give an idea of the type of displacement which is referred to, the first end portion may be displaceable in a generally diametral sense in the opening by an amount of about $\frac{1}{8}$th to $\frac{1}{2}$ of an inch. Greater or lesser amounts of displacement may be useful provided that sufficient displacement is permitted between the telescopic slide arrangement and the drawer to permit self-alignment of the drawer. To facilitate displacement, the first said telescopic member which is generally provided with a constant depth throughout its length, has its first end portion provided with a depth which is reduced by at least about $\frac{1}{2}$ relative to the constant depth of the main portion thereof. It will be furthermore noted that since the first said telescopic member is mounted for loose engagement in the above-mentioned opening, it is therefore mounted in cantilever fashion on the drawer.

While the aforesaid description of a form of the invention relates to the combination of a drawer in a piece of furniture or the like, and a telescopic slide arrangement, the invention may also be regarded as providing simply a slide bracket construction. In accordance therewith, the slide bracket comprises, consistent with the aforegoing, first and second telescopically engaged members respectively adapted for connection to a drawer and to a support for the drawer. The first member includes first and second end portions, said second end portion including a flap adapted for connection to one end of the drawer and the first end portion being of reduced dimensions and adapted for being received with loose fit in an opening provided in another end of the drawer. The first end portion of the first member may be provided, as has been noted, with a hole whereby to accommodate a guide, The first member may be, for example, about one foot in length or greater with the telescopically engaged second member being of corresponding length.

In further accordance with the invention, there is provided a method for mounting a drawer, having front and rear end portions, in a supporting member, the method comprising forming an opening in the front end portion of the drawer and connecting one of two telescopically engageable members to the drawer by inserting one end of said member loosely into the opening for transverse displacement therein and connecting the other end of said member to the rear end portion of the drawer. The method will comprise other steps consistent with the aforegoing description and the detailed description which follows hereinbelow.

Other objects, features and advantages of the invention will be found in the following detailed description as illustrated in the accompanying drawing.

DETAILED DESCRIPTION

Figure 1:
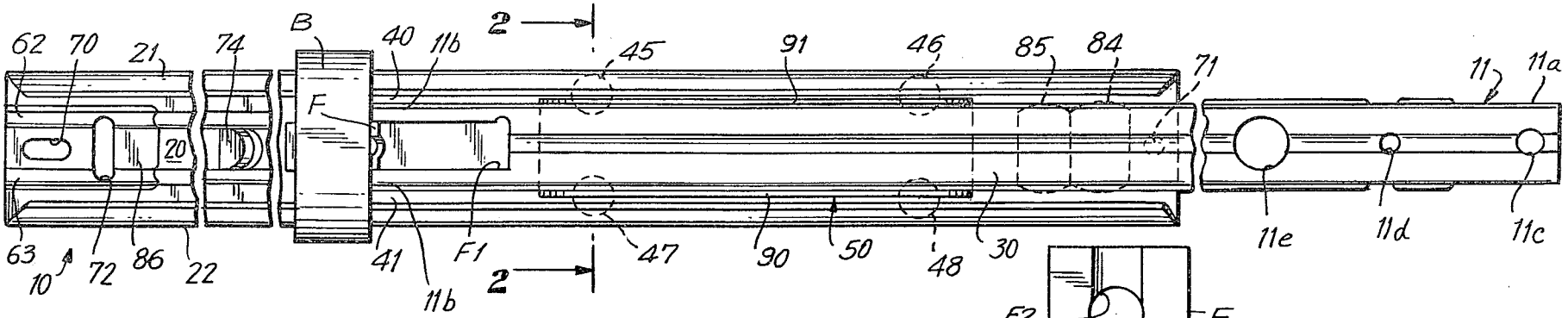
FIG. 1 is a plan view, partly broken away, of a slide bracket of the invention and the telescopically engaged members thereof.

The slide bracket shown in the drawings includes first and second elongated and telescopically engageable slide members 10 and 11 mounted for relative telescopic sliding movement. These members are respectively attached to a piece of furniture C or the like and a drawer D to allow drawer D to be extended or retracted.

Figure 2:
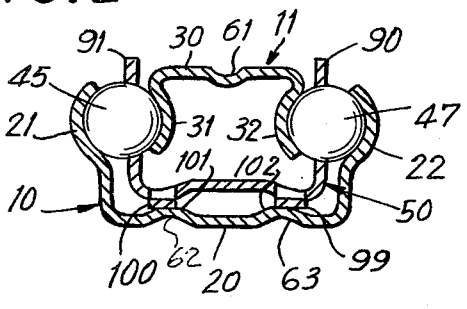
FIG. 2 is a sectional view taken along line 2—2 in FIG. 1.

The slide member 10 includes a base 20 and upstanding walls 21 and 22. The slide member 11 includes base 30 and upstanding walls 31 and 32. The walls 21, 31 and 22, 32 face one another and are respectively of part circular shape so as to define longitudinal ball bearing tracks 40 and 41. The tracks 40 and 41 define circular sections as seen in FIG. 2 and ball bearings 45, 46, 47 and 48 are disposed in these tracks to facilitate the relative longitudinal sliding movement of the members 10 and 11.

The ball bearings are mounted on a carrier 50 which is slidably displaceable between the members 10 and 11. As will be seen, slide member 10 is secured to the fixed housing or casing C and member 11 is attached to a slidable drawer D. In operation, member 11 is longitudinally and telescopically displaced relative to member 10 by sliding movement thereof as facilitated by the provision of the ball bearings mounted on carrier 50 as aforesaid.

The slide member 11 is provided with a longitudinal groove 61 extending along the length thereof, whereas the slide member 10 is provided with two longitudinal grooves 62 and 63 extending along the length thereof. These longitudinal grooves 61, 62 and 63 provide a hinge action which allows lateral deflection of the side walls of the respective side member. Such lateral deflection reduces the generation of retarding pressure on the side walls of the track by the ball bearings. This in turn substantially eliminates the production of noise during longitudinal relative sliding movement of the slide member. The attachment of the member 10 to the housing structure C is effected by inserting screws through holes 70 and 71 at opposite ends of the member 10.

Member 10 is provided with a pair of stops which are intended to limit the longitudinal displacement of the carrier element 50. One of these stops is indicated at 74. It is constituted by a tab which is punched out of the base 20 of the elongated member 10. The other of the stops is constituted by an inwardly directed protrusion 84. This protrusion is in the general form of a cylinder extending transversely of the longitudinal axis of the base 20 of the elongated member 10. When the carrier 50 moves in the direction of the stop 84, the base 20 rides upwardly onto the protrusion 84 and forces the ball bearings against the side of the tracks in which they are riding thereby causing the carrier to come to a stop due to a frictional braking.

Directly adjacent the protrusion 84 is another protrusion extending from the base in opposite direction to the direction of protrusion of the stop 84. This second protrusion is identified at 85. A corresponding protrusion 86 is provided at the other extremity of the elongated member 10. These two protrusions 85 and 86 constitute supports or feet for the elongated member 10 by which the elongated member 10 may be supported on a wall of the housing or other such supporting article of furniture C.

The carrier 50 is provided with four protrusions or bridge-like projections, two of which are indicated generally at 99 and 100. These protrusions or feet ride along the base of the member 10. More particularly, it will be noted that the grooves 62 and 63 result in the formation of ridges 101 and 102, thereby minimizing friction between the feet 99 and 100 and the base 20 while further enhancing the integrity of the structure and providing again for further minimizing of noise which might otherwise be generated by a sloppy fit between the elongated members 10 and 11.

Figure 5:
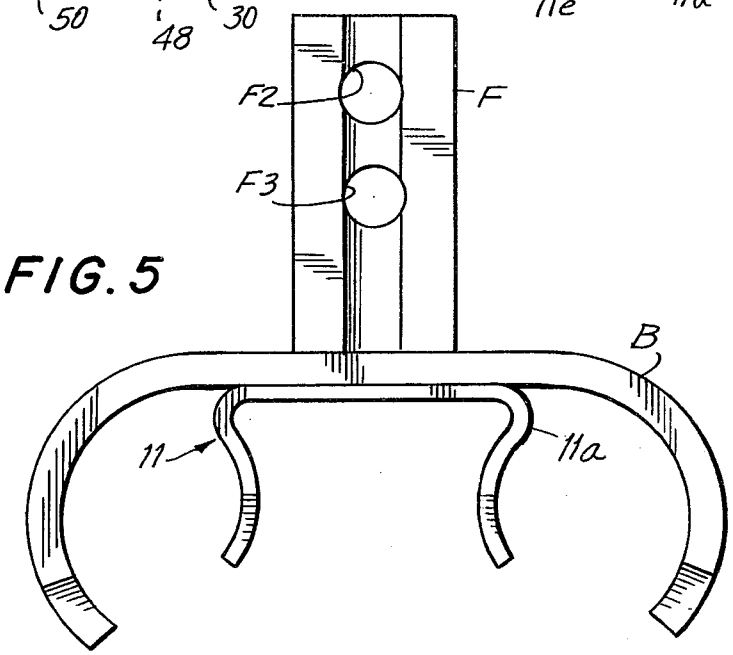
FIG. 5 is an end view of the member of FIGS. 3 and 4.
Figure 3:
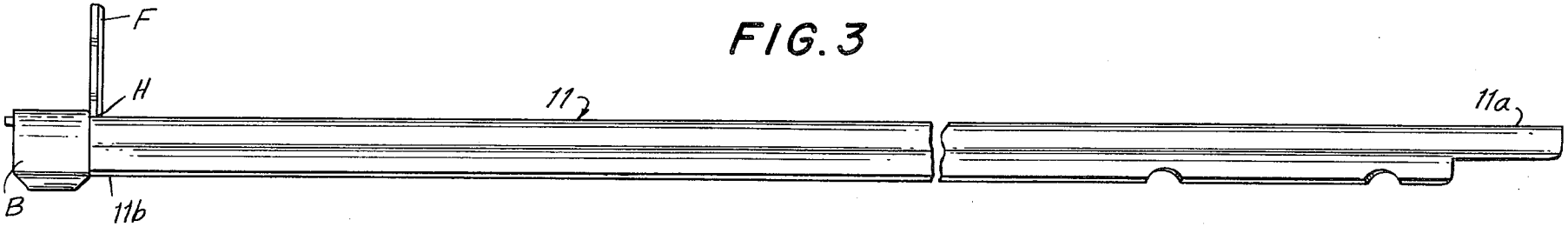
FIG. 3 is a side view of one of the telescopically engaged members of FIGS. 1 and 2.
Figure 4:
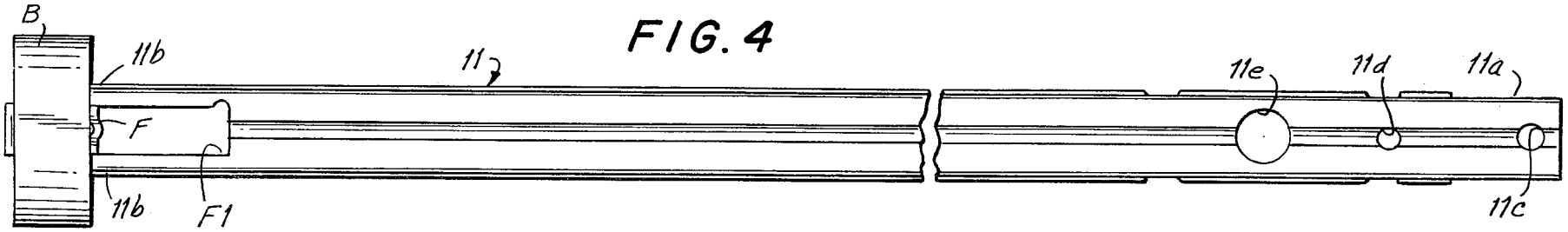
FIG. 4 is a top view of the member of FIG. 3.

As best seen in FIGS. 3–5, telescopic member 11 is provided with a first end portion 11*a* and a second end portion 11*b*. Member 11 is constructed, for example, of steel and may furthermore be, by way of example, one foot in length or greater. Smaller dimensions are also possible within the scope of the invention. As appears in FIG. 8, the main body of member 11 is provided with a generally constant height H, whereas the end portion 11*a* is provided with a depth which is reduced to about $\frac{1}{2}$ or less of the dimension H. Greater or lesser magnitudes of depth S for the end portion 11*a* are also permissible within the scope of the invention.

On the end portion 11*b* of member 11 is mounted a C-shaped band B, the function of which is to facilitate the accommodation and installation of this end of the member 11 in an accomodating recess. More significant in accordance with the invention is the fact that punched out of the end portion 11*b* is a flap F which is bent upwardly thereby leaving an opening F1 in the end portion 11*b*. The flap F thereby is formed along a hinge line H so that the body of member 11 may partake of a limited amount of hinged action relative to the flap F. Flap F is moreover provided with two or more openings, such as indicated at F2 and F3, these openings accommodating screws by means of which the end 11*b* of member 11 is fastened to an accompanying case member or support or supporting member C which may conventionally be a piece of furniture or the like.

It will furthermore be noted that the end portion 11*a* is provided with one or more openings, such as indicated at 11*c*, 11*d* and 11*e*. Opening 11*c* which is, for example, formed in the portion of reduced depth is intended to accommodate a guide, the details of which will be explained hereinafter.

Figure 8:
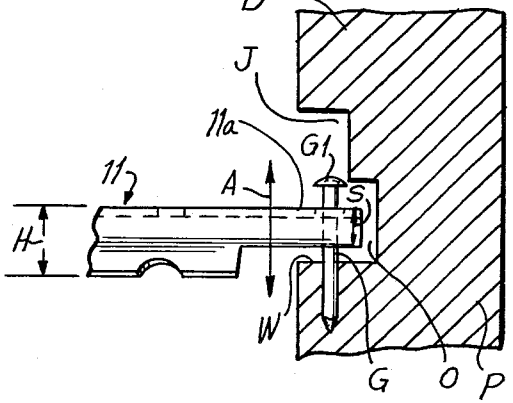
FIG. 8 is a view of a detail of FIG. 6 shown partly in section.
Figure 7:
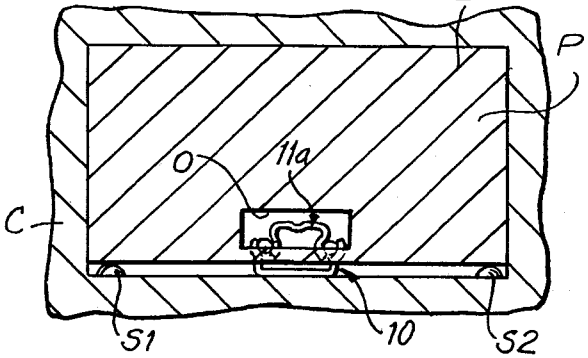
FIG. 7 is a front view in section along line 7—7 of FIG. 6 of the drawer of FIG. 6 installed in a casing member.
Figure 6:
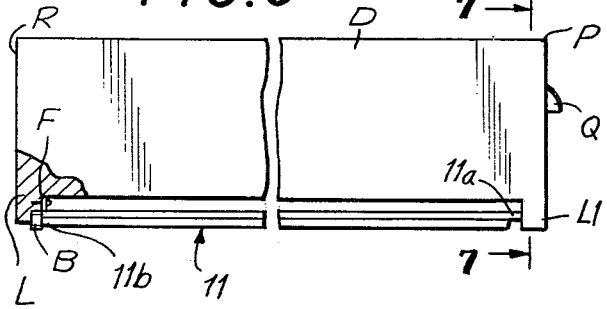
FIG. 6 is a diagrammatic side view of a drawer, partially broken away, with a bracket of the invention installed therein.

In accordance with further aspects of the invention, there are indicated in FIGS. 6–8 drawer D and case or supporting member C within which the drawer is accommodated for slidable displacement. It is to be noted that these Figures are generally diagrammatic and intended to illustrate the operation of structures of the invention rather than the details thereof. In FIG. 6 in particular, it will be noted that the telescopic member 11 extends along and beneath the drawer D on the outside of the latter with the end portion 11*b* being fixed by flap F to a depending lip or rim L on the rear end portion R of the drawer. The extremity of end portion 11*d* is accommodated in a recess provided in the lip L and the flap is fixed by means of screws or nails or the like. This fixing is furthermore accomplished by the utilization of commercially available glue which is well known for this purpose, in order to provide for a non-detachable, substantially rigid coupling. The affixation of flap F permits a slight hinge action of the main body of member 11 relative to the hinge line H mentioned hereinabove with respect to FIG. 3.

The end portion 11*a* of telescopic member 11 accommodated in an opening O provided in lip L1 depending from the front end portion P of the drawer D, which is furthermore provided with a handle Q. As is best seen in FIG. 8, the opening O is of a transverse dimension exceeding the dimension S of the end portion 11*a* of member 11. This in turn provides for the loose accommodation referred to hereinabove so that the end portion 11*a* is transversely displaceable in opening O in directions indicated by arrow A. To retain the end portion 11*a* in the opening O and to limit the displacement of same to a vertical plane substantially free from horizontal components, there is provided a guide G. The guide G is a pin-like member, such as a spike or nail or rivet or screw, having a head indicated at G1. This pin-like member extends through the opening 11*c* in the end portion 11*a*. In order to facilitate the mounting of the pin, the opening O is provided with an enlargement or jog J. This opening facilitates the installation of the guide G which penetrates into the body of the front end portion P adjacent the opening O and more particularly, in wall W of this opening.

As is best seen in FIG. 7, the case member C is provided with an opening within which the drawer D is accommodated. In this Figure, the front section of the drawer, indicated at P, is shown in section thereby exposing the opening O within which can be seen loosely accommodated the end portion 11*a* of the member 11. The member 10 is illustrated as mounted on the casing C and the bottom of the drawer rests upon two slides or guides S1 and S2. The members 10 and 11 are in telescopic engagement with the ball bearings being located therebetween. Due to the loose fit of end portion 11*a* in opening O, a certain relative displacement may take place between the end portion 11*a* and the front end P of the drawer D. This permissible deflection provides for an automatic alignment of the drawer relative to the slide bracket thereby obviating the labor intensive and costly time consuming adjustment of the drawer relative to the bracket. This advantageous result is achieved simply by providing the above described loose fit between at least one part of the slide bracket and the associated drawer. Further advantage is achieved at the slight cost of providing the guide G in the manner which has been mentioned above. It is thus obvious that according to one aspect of the invention, there is provided an article of manufacture comprising a case member with a drawer slidably mountable therein and a telescopic slide arrangement coupled between the drawer and the case member, the telescopic slide arrangement including at least one telescopic member, having at least one loose engagement with the drawer to permit limited displacement between this telescopic member and the drawer and thereby a self-alignment of the drawer relative to the case member. It also appears that one of the telescopic members is mounted in a cantilever fashion on the drawer with a limited hinge action being provided to accommodate the above-mentioned displacement within the opening O.

In accordance with the invention, there is thus provided a method of mounting a drawer, having front and rear end portions or parts, in a supporting member, the method comprising forming an opening in the front end portion of the drawer and connecting one of two telescopically engageable members to the drawer by inserting one end of said member loosely into said opening for transverse displacement therein and connecting the other end portion of this member hingedly to the rear end portion of the drawer. The method of the invention furthermore comprises inserting a pin-like member into the opening in engagement with said one end to form a guide for this one end thereby limiting displacement of this one end to a vertical plane.

Other aspects of the method of the invention include forming a jog in the opening and inserting the aforesaid pin-like member through the jog into and transversely of the opening. To complete the arrangement, the other telescopically engageable member is mounted on the case or supporting member. More specific aspects of the method comprise punching a flap out of the one telescopically engageable member along a hinge-line and fastening the flap to the rear end portion of the drawer by means of screws or the like and/or by gluing the flap to the rear end portion.

Although the invention has been described with reference to a specific embodiment thereof, numerous modifications and variations will become evident to those skilled in the art without departing from the scope of the invention as defined in the following claims.

What is claimed is:

1. An article of manufacture comprising a case member, a drawer slidably mountable in said case member, and a telescopic slide means coupled between said drawer and said case member and engaging the drawer for sliding displacement relative to said case member, said telescopic slide means including at least one telescopic member having at least one loose engagement with said drawer to permit limited displacement between said one telescopic member and drawer and thereby a self alignment of said drawer relative to said case member, said drawer being provided with an opening and said telescopic member protruding into said opening and having a loose fit therein to permit said limited displacement, said drawer including front and rear parts and the first said telescopic member extending along the outside of said drawer between said front and rear parts, said opening being provided in one of said parts, the first said telescopic member including a first end portion extending with loose fit into said opening and a second end portion adjacent the rear part of the drawer, said article further including connecting means connecting said second end portion to the rear part of the drawer, said telescopic slide means including a second telescopic member mounted on said case member and telescopically coupled with the first said telescopic member, said opening being a blind bore opening, said opening including a jog of increased dimensions at the entry into said opening, said article further including a guide means located at least partly in said jog to engage and guide displacement of said first end portion and to retain the latter in said opening.

2. An article of manufacture as claimed in claim 1, wherein said guide means includes a pin-like member extending at least partly across said opening and said first end portion is provided with a hole through which the pin-like member extends.

3. An article of manufacture as claimed in claim 2, wherein the second end portion includes a flap and said connecting means includes a fastener fastening said flap to the rear part of the drawer, said flap having a hinge action which, abetted by the resilience of the first said telescopic member, accommodates displacement of said first end portion in said opening.

4. An article of manufacture as claimed in claim 3, wherein the first end portion is displaceable in a generally diametrical sense in said opening by an amount between about $\frac{1}{8}$th and $\frac{1}{2}$ of an inch.

5. An article of manufacture as claimed in claim 4, wherein the first said telescopic member has a generally constant depth throughout the length thereof except for said first end portion whereat said depth is reduced by at least about one-half.

6. An article of manufacture as claimed in claim 3, wherein the first said telescopic member is mounted in cantilever fashion on said drawer.

* * * * *